US009938060B2

(12) United States Patent
Jian et al.

(10) Patent No.: US 9,938,060 B2
(45) Date of Patent: Apr. 10, 2018

(54) CONTAINER AND LID LOCKING MECHANISM THEREOF

(71) Applicant: SHANGHAI HONGYAN RETURNABLE TRANSIT PACKAGINGS CO., LTD, Shanghai (CN)

(72) Inventors: Yuanli Jian, Shanghai (CN); Kai Gong, Shanghai (CN)

(73) Assignee: Shanghai Hongyan Returnable Transit Packagings Co., Ltd., Shanghai (CN)

( * ) Notice: Subject to any disclaimer, the term of this patent is extended or adjusted under 35 U.S.C. 154(b) by 0 days.

(21) Appl. No.: 15/111,377

(22) PCT Filed: Jan. 13, 2015

(86) PCT No.: PCT/CN2015/070575
§ 371 (c)(1),
(2) Date: Jul. 13, 2016

(87) PCT Pub. No.: WO2015/104002
PCT Pub. Date: Jul. 16, 2015

(65) Prior Publication Data

US 2016/0340091 A1 Nov. 24, 2016

(30) Foreign Application Priority Data

Jan. 13, 2014 (CN) ..... 2014 1 0014687

(51) Int. Cl.
*B65D 45/16* (2006.01)
*B65D 55/02* (2006.01)
(Continued)

(52) U.S. Cl.
CPC ..... *B65D 55/02* (2013.01); *B65D 19/18* (2013.01); *B65D 25/005* (2013.01); *B65D 45/16* (2013.01);
(Continued)

(58) Field of Classification Search
CPC ..... B65D 55/02; B65D 45/16; B65D 19/18; B65D 2519/00502; B65D 2519/00333;
(Continued)

(56) References Cited

U.S. PATENT DOCUMENTS 8,511,496 B2 * 8/2013 Van Der Korput .... B65D 19/06 220/4.08
8,757,412 B2 * 6/2014 Sommer ..... B65D 11/1833 220/4.28
(Continued)

FOREIGN PATENT DOCUMENTS

CN 201385904 1/2010
CN 102795436 11/2012
(Continued)

OTHER PUBLICATIONS

International Search Report for international application No. PCT/CN2015/070575, dated Mar. 27, 2015 (4 pages, including English translation).

*Primary Examiner* — Kareen Thomas
(74) *Attorney, Agent, or Firm* — Hamre, Schumann, Mueller & Larson, P.C.

(57) ABSTRACT

A container lid locking mechanism and a container. The container is provided with a base (3), side boards (2), and a lid (1). The locking mechanism comprises buckles (6), return members (7), recesses (8), openings (11), and locking holes (10). The recesses (8) and the openings (11) are located in the edge of the lid (1), and the locking holes (10) are located in the side boards (2). Each of the buckles consists
(Continued)

of a buckle body and a tongue (61) extending out from the buckle body. The return members (7) can enable the buckles (6) to be kept in a locked position. The recesses (8) are used for accommodating the buckle bodies. Two pairs of limit structures are disposed on the buckles (6) and in the edge recesses (8) of the lid (1). When the locking mechanism locks, the pair of limit structures (13, 66) on the buckles (6) and the lid (1) are in a fitted state to limit the buckles (6). The tongue (61) penetrates through the opening (11) at the edge of the lid (1) and is fastened into the locking hole (10) in the side board (2). When the locking mechanism is in an unlocked state, the other pair of limit structures (16, 63) on the buckles (6) and the lid (1) are in a fitted sate to limit the buckles (6), and the tongue (61) exits from the locking hole (10) in the side board (2).

10 Claims, 7 Drawing Sheets

(51) Int. Cl.

| | |
|---|---|
| ***B65D 19/18*** | (2006.01) |
| ***B65D 25/00*** | (2006.01) |
| ***E05B 83/02*** | (2014.01) |
| ***E05C 1/10*** | (2006.01) |

(52) U.S. Cl.
CPC ..... *E05B 83/02* (2013.01); *E05C 1/10* (2013.01); *B65D 2519/00034* (2013.01); *B65D 2519/00069* (2013.01); *B65D 2519/00174* (2013.01); *B65D 2519/00208* (2013.01); *B65D 2519/00333* (2013.01); *B65D 2519/00502* (2013.01); *B65D 2519/00711* (2013.01)

(58) Field of Classification Search
CPC ..... B65D 2519/00288; B65D 2519/00711; B65D 2519/00208; B65D 2519/00174; B65D 2519/00069; B65D 2519/00034; B65D 2519/00273
USPC .. 220/315, 324, 326, 203.1, 203.33, 203.26, 220/240, 246, 264, 292, 295, 302, 823, 220/827, 838, 345.3, 348, 212, 4.08, 4.16, 220/4.28–4.34, 666, 6, 7
See application file for complete search history.

(56) References Cited

U.S. PATENT DOCUMENTS

| | | | | |
|---|---|---|---|---|
| 8,820,558 | B2 * | 9/2014 | Van der Korput ..... | B65D 19/08 206/386 |
| 2005/0150892 | A1 * | 7/2005 | Miller ..... | B65D 19/18 220/324 |
| 2009/0205169 | A1 * | 8/2009 | Nolan ..... | B65D 11/18 16/321 |
| 2012/0152947 | A1 * | 6/2012 | Orgeldinger ..... | B65D 11/184 220/7 |
| 2013/0048652 | A1 * | 2/2013 | Orgeldinger ..... | B65D 11/1833 220/666 |
| 2014/0326721 | A1 * | 11/2014 | Jian ..... | B65D 88/52 220/6 |

FOREIGN PATENT DOCUMENTS

| | | |
|---|---|---|
| CN | 202717236 | 2/2013 |
| CN | 103754516 | 4/2014 |
| CN | 203740414 | 7/2014 |
| FR | 2837805 | 10/2003 |
| JP | H0516941 | 1/1993 |
| JP | 2005163872 | 6/2005 |
| JP | 2012140133 | 7/2012 |

* cited by examiner

CONTAINER AND LID LOCKING MECHANISM THEREOF

TECHNICAL FIELD

The present invention relates to a container, in particular to a locking mechanism to lock a container lid to a container body.

BACKGROUND

A large container generally has four side plates and a base, and a lid is also provided for a large container used in transportation of bulks or liquids so as to protect the cargo inside the container. There is provided with an edgeguard around the lid close to the outer sides of the four side plates. When the cargo inside the container applies a large force against the side plates, to a certain extent the edgeguard of the lid will prevent the side plates from deforming too much. Further, when the liquids or bulks inside the container fluctuate upwardly, the lid will limit the fluctuation of a liner bag containing the liquids or bulks, thus preventing the liner bag from being damaged. Thus, the lid should be reliably connected to the container when used. In addition, the four side plates of the large container can be successively folded so as to reduce the space occupied when not in use, thus reduce the costs of turnover and warehousing of products. Further, when the lid is placed on the folded container, the mechanism of lid connected to the container should avoid accumulating high altitude.

One of current locking means for locking a lid to a container comprises a latch with a handle and a pit on the upper edge of the lid to accommodate the latch. A hole is provided on the sidewall of the pit, through which the latch will extend into a locking hole on a side plate of the container. When the lid is in use, the latch will limit the upward movement of the lid, while the lateral movement of the handle on the latch is limited by the rib in the pit, so that the lid can be reliably locked. This kind of design basically achieves the connection of the lid to the container. However, when the lid is placed on the container and the latch is in extended state, the latch will be pressed directly on the side plate of the container, so that the latch may be damaged, since there is not a reset structure. Furthermore, when lifting the lid using the handle, the handle itself will bear the full weight of the lid, so that the handle is easy to be damaged.

There is another current lid locking member, which is secured to the lid through a serial of plastic buckle and can rotate a certain angle around the buckle as a center. A metal turning embodied part with a groove is provided on the side plate of the container, which passes through a through-hole pre-provided on the lid and exposes the groove above the lid when the lid is covered on the container body. And then the locking member is rotated to the groove of the metal embodied part, so as to lock the lid to the container body. However, this embodiment has the same problem as said above: when the locking member is unlocked and the lid needs to be removed, the locking member itself used as a handle will bear the full weight of the lid, so that the locking member is easy to be damaged. At the same time, it is inconvenient to install and disassemble the locking member through the connection of plastic buckle.

SUMMARY

The aim of the present invention is to provide a lid locking mechanism of a container with high reliability and prolonged service life, which can be conveniently installed and removed and smoothly operated.

In order to achieve the above aim, a lid locking mechanism of a container is provided. The container has a base, side plates and a lid, wherein the locking mechanism includes a locking member, a reset member, a pit and an opening located on edge of the lid, and a locking hole located on the side plates, wherein the locking member consists of a locking body and a latch extending from the locking body, and the reset member may keep the locking member in a locking position, and the pit is used for accommodating the locking body, and two pairs of position limiting structures are provided on the locking member and in pit located on the edge of the lid; and one pair of the position limiting structures provided on the locking member and on the lid are cooperated with each other so as to limit the position of the locking member, and the latch passes through the opening located on the edge of the lid and is snapped into the locking hole located on the side plates when the lid is locked on the side plates by the locking mechanism; the other pair of the position limiting structures provided on the locking member and on the lid are cooperated with each other so as to limit the position of the locking member, and the latch exits from the locking hole located on the side plates when the locking mechanism is in an unlocking state.

Preferably, the two pairs of the position limiting structures are provided so that there is a third position where the two pairs of the position limiting structures are both disengaged with each other during the process that the locking member moves in the pit located on the edge of the lid, and it is convenient to install the locking member on the lid or remove the locking member from the lid due to the presence of the third position.

Preferably, a pair of auxiliary position limiting structures are provided on the locking member and on the edge of the lid, and the auxiliary position limiting structures are always cooperated with each other during the process that the locking member moves in the pit located on the edge of the lid, so as to prevent the locking member from easily removing from the lid due to misoperation when the locking member moves to the disengagement position.

Preferably, the reset member is a spring, and the pit located on the edge of the lid is provided with an opening groove, and the locking member is provided with a bottom pit, and the spring is installed in a space formed by the opening groove and the bottom pit, and the length of a portion of the bottom pit accommodating the spring is shorter than the nature length of the spring.

Preferably, the two pairs of the position limiting structures consists of two fastenings provided on the locking members and two corresponding hanging steps provided in the pit located on edge of the lid, wherein one fastening and one corresponding hanging step form a pair of position limiting structures.

In one embodiment, the above fastening consists of a left fastening and a right fastening and the above hanging step consists of a left hanging step and a right hanging step, wherein the left fastening is provided on the left sidewall of the pit and the right fastening is provided at substantially middle position in the pit and connected to the opening groove for accommodating the spring; the opening is provided on the right sidewall of the pit and the auxiliary hanging groove is a groove provided on the side wall of the pit along the length of the pit; the auxiliary pit is provided on the left side of the pit and the notch, the pit and the auxiliary pit are cooperated to each other and the opening is aligned with the locking hole when the lid is placed on the side plates and doors. The locking member is provided with a left hanging step on one end for cooperating with the left fastening in the pit located on the edge of the lid and an auxiliary hanging part on the side surface of the locking member which can sliding in the auxiliary hanging groove; the locking member is further provided with a bottom pit with a downward opening for accommodating the opening groove in the pit located on the edge of the lid and the spring, and a right hanging step which may be cooperated with the right hastening is provided on one side of the bottom pit.

Preferably, the latch has a slop.

Preferably, the two pairs of the position limiting structures consist of two pin holes provided on the locking members and two corresponding position limiting pins provided in the pit located on the edge of the lid, wherein one pin hole and one corresponding position limiting pin form a pair of position limiting structures.

Preferably, the locking member is provided with a locking member pit and the edge of the lid is provided with an auxiliary pit, wherein the auxiliary pit and the locking member pit are used to accommodate fingers and used as a site for applying force from fingers.

Preferably, the pair of the auxiliary position limiting structures consists of an auxiliary hanging part provided on the locking member and an auxiliary hanging groove provided in the pit located on the edge of the lid, wherein the auxiliary hanging part keeps engaging with the hanging groove and the auxiliary part slides along the auxiliary groove during a process that the locking member moves in the pit located on the edge of the lid.

Preferably, the locking member is made of plastic.

Preferably, distance between the two fastenings is longer than that between the two hanging steps.

Preferably, distance between the two pin holes is shorter than that between the end surfaces of the two position limiting pins.

The present invention further provides a container including a base, a side plate and a lid, wherein the container is further provided with the above lid locking mechanism of a container.

The lid locking mechanism of a container of the present invention is reasonably provided with two pairs of position limiting structures and a pair of restraint structures, so as to install or remove the locking mechanism more conveniently and ensure the operation of the locking mechanism more smoothly. The auxiliary pits designed on the lid edge results in that the removing operation of lid is more convenient and of less effort and the weight shared by the lock member when lifting the lid is reduced, thus increasing reliability of the locking member and prolonging service life of the locking member.

DETAILED DESCRIPTION

Figure 1:
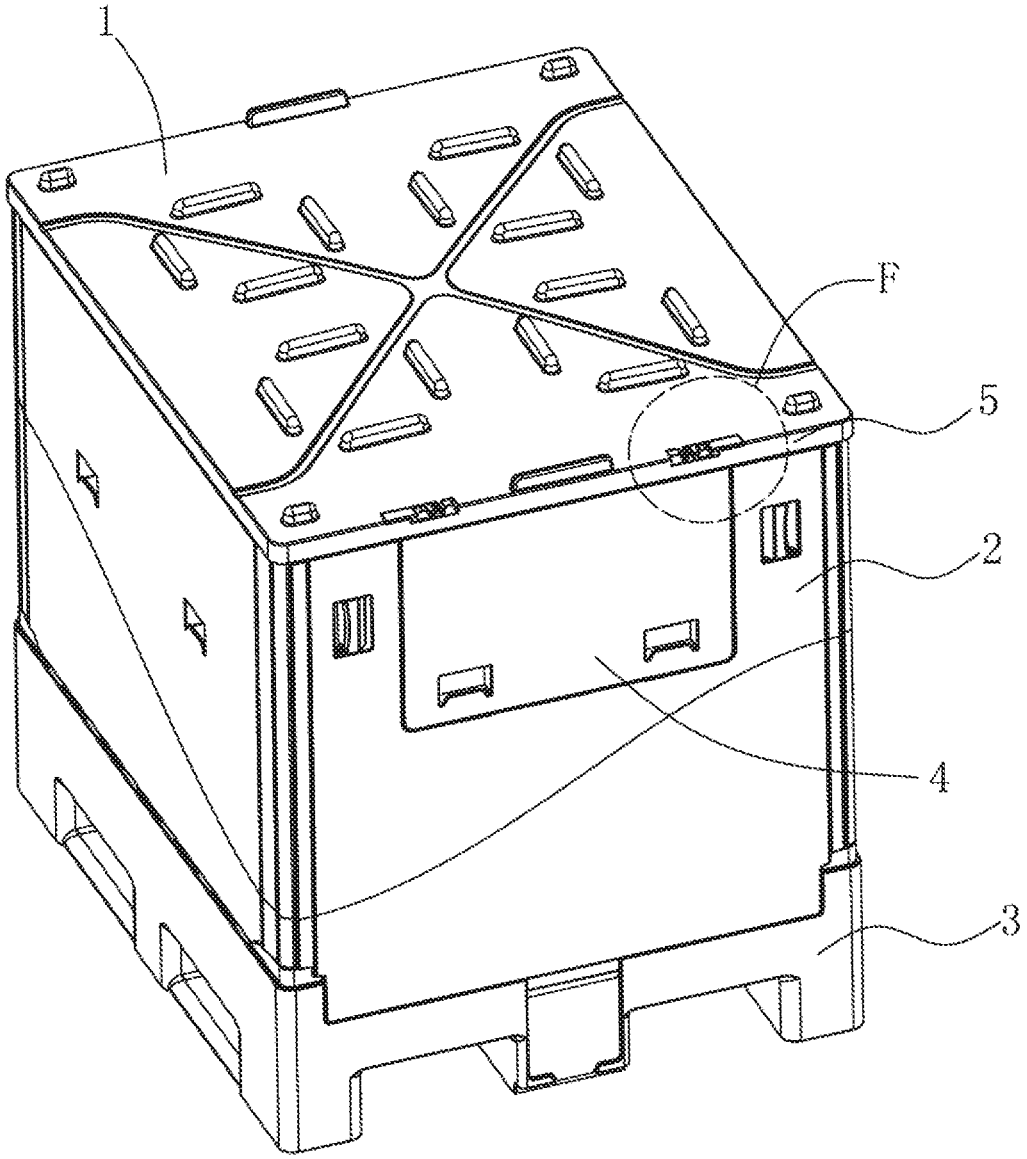
FIG. 1 is a perspective structure view of a container with the lid locking mechanism according to the first embodiment of the present invention.

Hereinafter, preferred embodiments of the present invention will be described in detail with reference to the drawings, so that the purposes, features and advantages of the present invention will be more clearly understood. It should be understood that embodiments shown in the drawings are not to limit the scope of the invention, but merely to illustrate the true spirit of the technical solution of the present invention. Herein, same or similar components are denoted by same reference numerals.

FIG. 1 shows a perspective structure view of a container with the lid locking mechanism according to the present invention. As shown in FIG. 1, the container includes a lid 1, side plates 2, a base 3 and a small door 4. When the lid 1 is placed on a body of container, the edgeguard 5 around the lid 1 will surround the outer surfaces of side plates 2 so as to improve the strength of the entire body. The lid 1 and the side plates 2 are locked by the locking mechanism in FIG. 1, and the lid locking mechanism of the present invention will be described in detail hereinafter.

Figure 2:
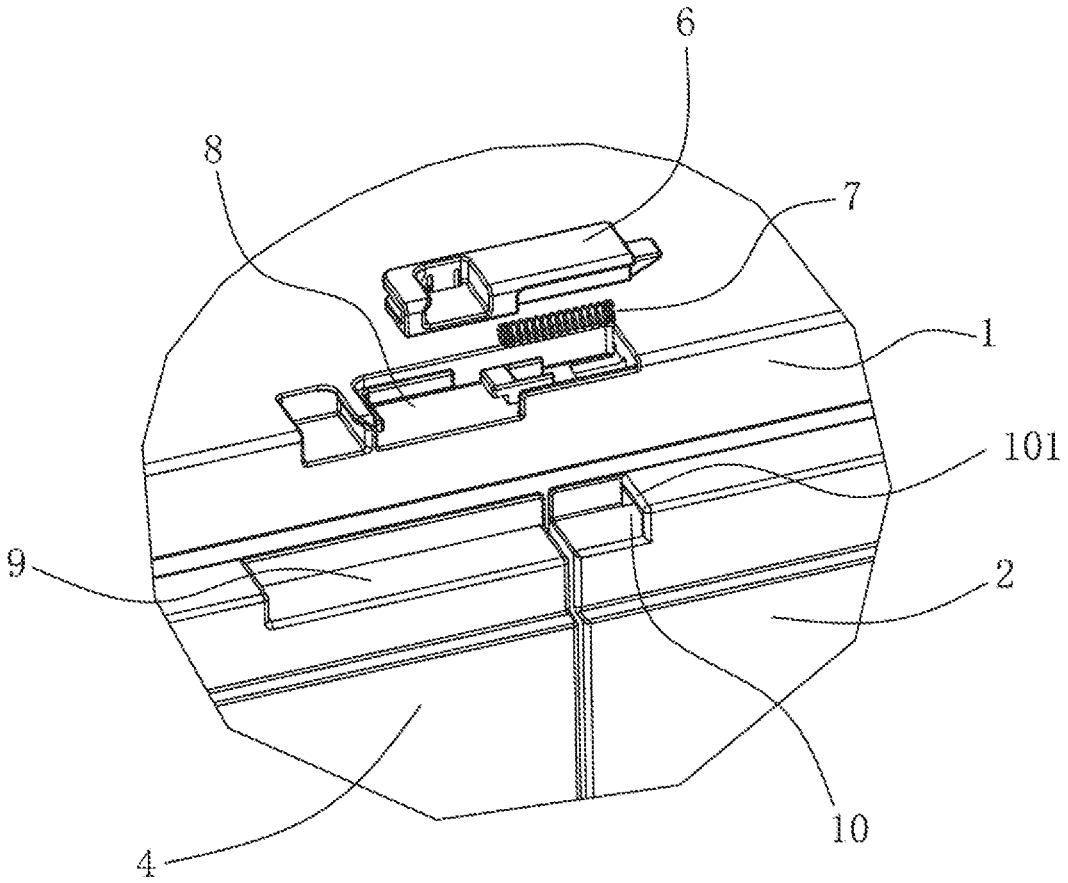
FIG. 2 is an exploded perspective structure view of part F in FIG. 1.
Figure 3:
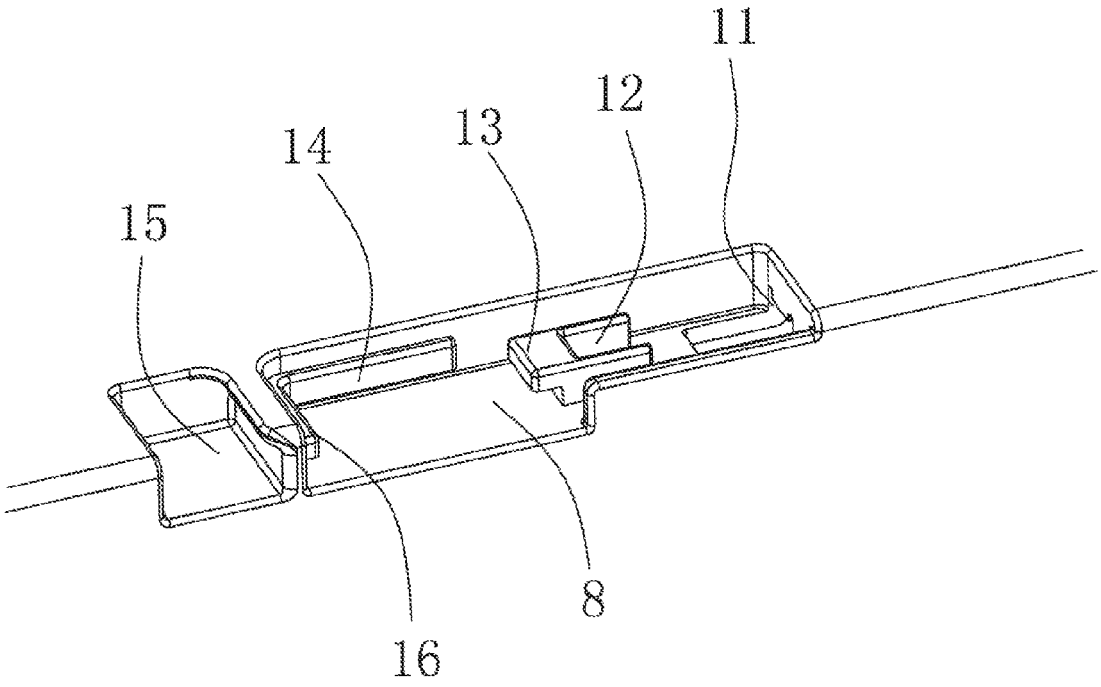
FIG. 3 is a partial enlarged view of the lid edge structure in FIG. 2.

FIG. 2 is an exploded perspective structure view of part F in FIG. 1 and FIG. 3 is a partial enlarged view of the lid edge structure in FIG. 2. As shown in FIGS. 2 and 3, the lid locking mechanism includes a locking member 6, a spring 7, a pit 8 provided on the edge of the lid 1, an opening 11, an opening groove 12, a right fastening 13, an auxiliary hanging groove 14, a left fastening 16, a auxiliary pit 15, and a notch 9 and a locking hole 10 provided on side plate 2 and small door 4. The left fastening 16 is located on the left sidewall of the pit 8. The right fastening 13 is located at substantially middle position in the pit 8 and connected to the opening groove 12 for accommodating the spring. The opening 11 is provided on the right sidewall of the pit 8. The auxiliary hanging groove 14 is a groove provided on the side wall of the pit 8 along the length of the pit 8. The auxiliary pit 15 is provided on the left side of the pit 8. The notch 9, the pit 8 and the auxiliary pit 15 are cooperated to each other and the opening 11 is aligned with the locking hole 10 when the lid 1 is placed on the side plates and small door.

Figure 4:
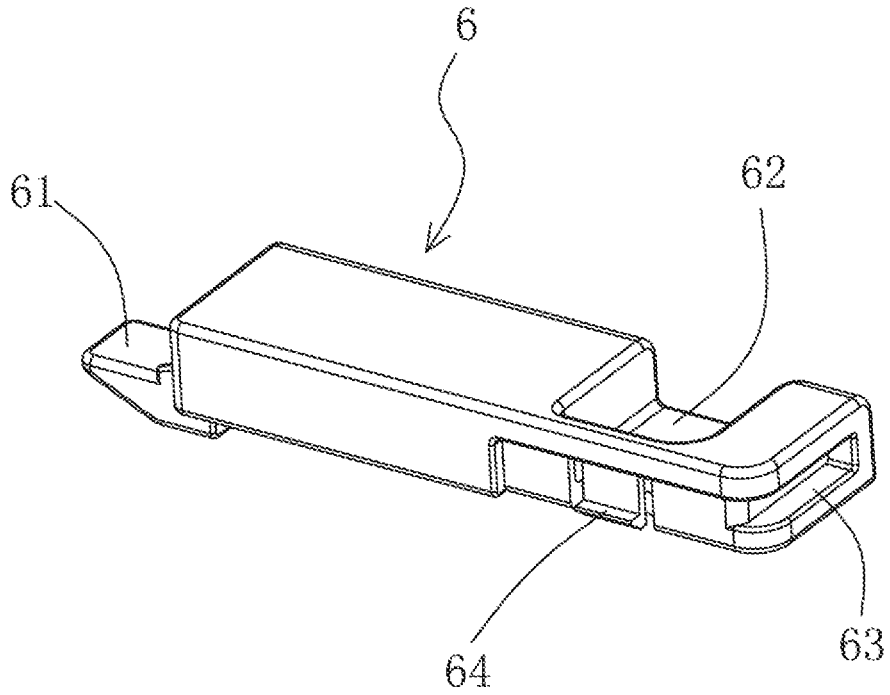
FIG. 4 is a perspective structure view of the locking member in FIG. 2 in a visual angle.
Figure 5:
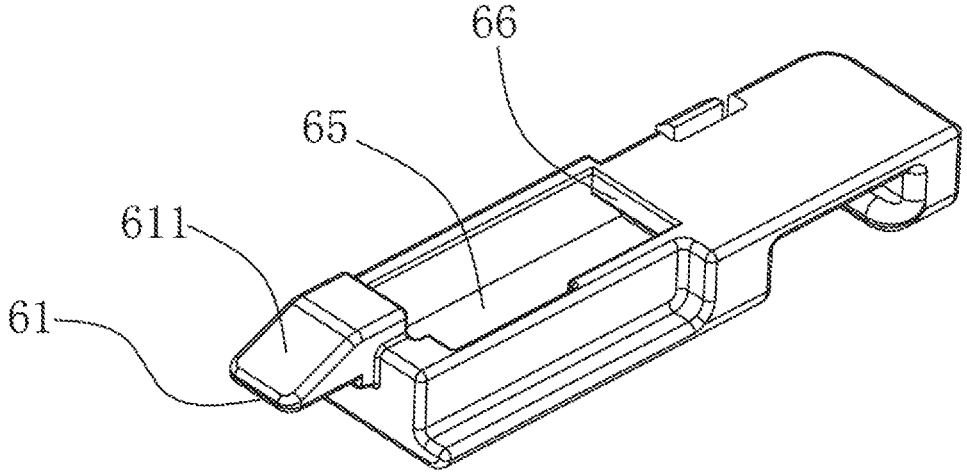
FIG. 5 is a perspective structure view of the locking member in FIG. 2 in another visual angle.

FIGS. 4 and 5 are perspective structure views of the locking member 6 in FIG. 2 in different visual angles respectively. As shown in FIGS. 4 and 5, the locking member 6 is provided with a latch 61 having a slop 611 on one end and a left hanging step 63 on the other end for cooperating with the left fastening 16 in the pit of the lid edge. The locking member 6 is provided with an auxiliary hanging part 64 on the side surface, which can slide along the auxiliary hanging groove 14. The bottom pit 65 with a downward opening is used to accommodate the opening groove 12 in the pit of the lid edge and the spring 7, and with a right hanging step 66 which may be cooperated with the right hastening 13 is provided at one side of the bottom pit 65. The locking member pit 62 with an upward opening provided on the locking member 6 and the auxiliary pit 15 provided on the lid edge are both used to accommodate fingers and provide a position to apply force from the fingers.

As can be seen from FIGS. 1-5, after the locking member 6 is installed on the lid 1, the auxiliary hanging part 64 of the locking member 6 is engaged with the auxiliary hanging groove 14 on the lid 1 and the spring 7 is placed in the opening groove 12, and the bottom pit 65 of the locking member 6 surrounds the opening groove 12 and accommodate the spring 7, wherein the resetting elasticity of the spring 7 will cause the latch 61 of the locking member 6 to pass through the opening 11 and keep the right hanging step 66 of the locking member 6 engaging with the right fastening 13 of the lid 1. And then, during the process that the lid 1 installed with the locking member 6 is pressed downward and placed on the side plates, the latch 61 moves toward left as its slope 611 is pressed by the top 101 of the locking hole 10 provided on the side plates, until the lid is completely placed on the side plates 2 and the small door 4, i.e. the pit structure of the lid edge is cooperated with the notch structures of the side plates and the small door, the latch 61 is no longer pressed by the top 101 of the locking hole and was pushed rightwards into the locking hole 10 of the side plates 2 due to the resetting elasticity of the spring, when the right hanging step 66 and the right hanging step 13 are cooperated together, so that the locking mechanism of the container locks the lid 1 to the side plates 2.

Figure 6:
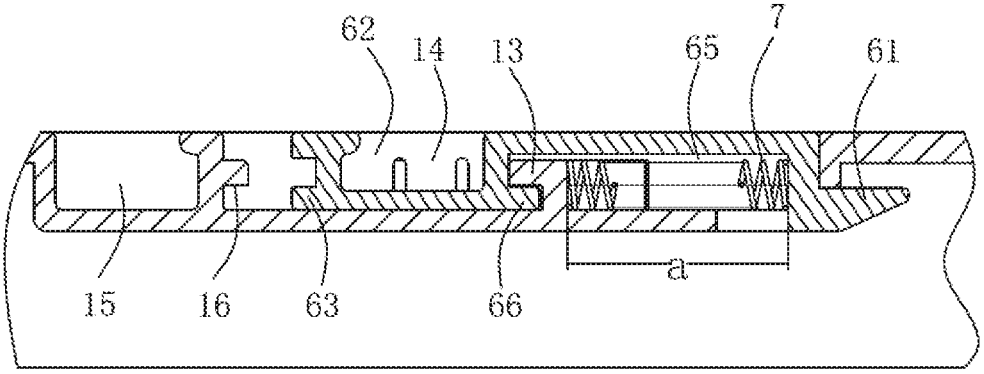
FIG. 6 is a schematic cross-sectional view of the lid locking mechanism of a container in a locking state according to the first embodiment of the present invention.
Figure 7:
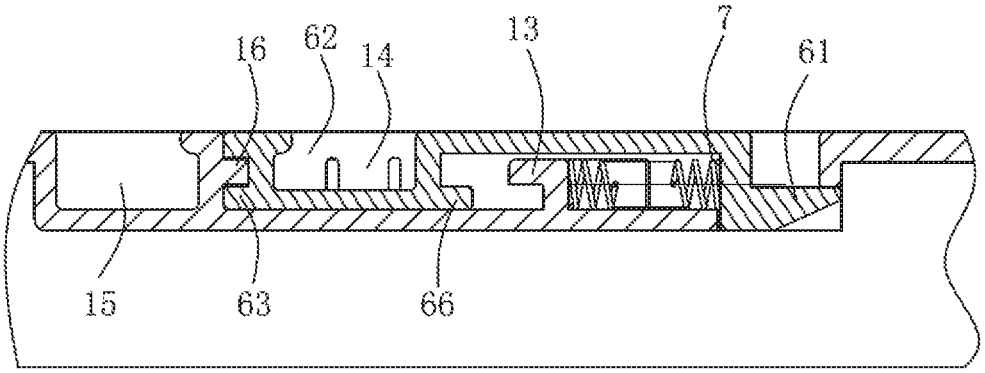
FIG. 7 is a schematic cross-sectional view of the lid locking mechanism of a container in an unlocking state according to the first embodiment of the present invention.
Figure 8:
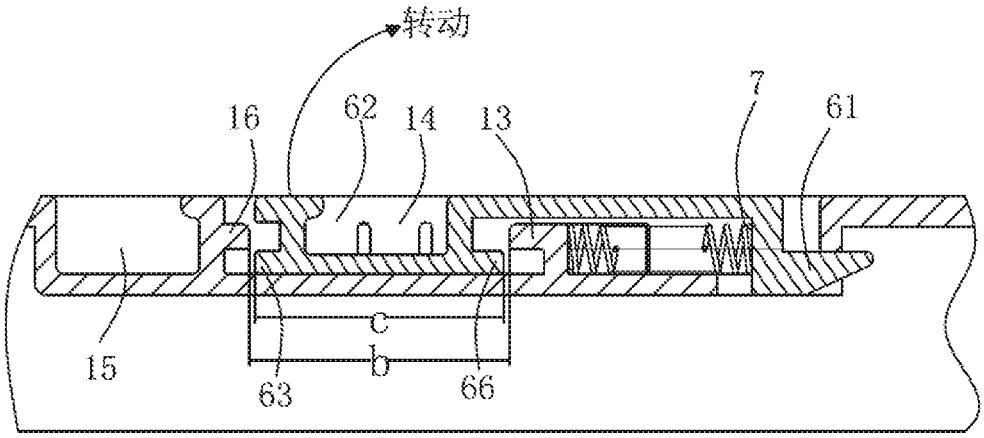
FIG. 8 is a schematic cross-sectional view of the lid locking mechanism of a container after being removed according to the first embodiment of present invention.

FIG. 6 shows a schematic cross-sectional view of the lid locking mechanism of a container in a locking state according to the present invention. In FIGS. 6-8, some structure of the spring 7 is simplified and the particular structures of the side plates and the small door are not shown. As shown in FIG. 6, length a of the bottom pit 65 of the locking member 6 is shorter than the nature length "$l_0$" of the spring 7 when the right hanging step 66 is engaged with the right hastening 13, so that the resetting elasticity of the compressed spring 7 force the latch 61 of the locking member 6 into the locking hole 10 of the side plates 2 and keep the locking mechanism in the locking state. The side plates 2 will press the latch 61 downward and the right hanging step 66 will engage with the right hastening 13 when the lid 1 is subject to an upward impact from the liquid in a container during transportation, so that the locking mechanism will be continually kept in the locking state rather than being unlocked.

FIG. 7 shows a schematic cross-sectional view of the lid locking mechanism of a container in an unlocking state according to the present invention. When unlocking is needed, thumb and index fingers can be inserted into the auxiliary pit 15 and the locking member pit 62, and the locking member 6 is pulled leftwards to the position shown in FIG. 7. The auxiliary hanging part 64 keeps engaging with the auxiliary hanging groove 14 and slides along the auxiliary hanging groove 14 during the translation of the locking member 6. When the locking member 6 is in the position shown in FIG. 7, the left fastening 16 is engaged with the left hanging step 63, and the latch 61 exits from the locking hole 10 but the head of the latch 61 does not completely exit from the opening 11 of the lid, when the thumb and index fingers placed in the auxiliary pit 15 and the pit 62 respectively apply force upward, so that one side of the lid 1 is upward disengaged from the side plates of the container while the locking member 6 is not easily to disengage from the lid 1. The auxiliary pit 15 increases points of applying pulling force to overcome the weight of the lid, so that the weight of the lid 15 can be shared by the auxiliary pit 15 and the engaging structure of the left fastening 16 and the left hanging step 63, thus avoiding risk that the locking member alone bears the weight of the lid and is easily damaged, thereby improving the reliability of the locking member and prolonging service life of the locking member.

If the locking member 6 is not required to be removed after the lid 1 is disengaged from the side plates of the container, the resetting elasticity of spring 7 will push the latch 61 into the opening 11 and the right hanging step 66 is engaged with the right hastening 63, so that the locking member 6 can be steadily kept on the lid 1.

FIG. 8 shows a schematic cross-sectional view of the lid locking mechanism of a container after being removed according to the present invention. Whether the locking member 6 is in locking state or unlocking state after being installed on the lid, the auxiliary hanging part 64 and the auxiliary groove 14 are always kept engaging with each other, so as to assure the operation stability of the entire locking member 6 during using process. As the distance "b" between the right fastening 13 and the left fastening 16 is longer than the distance "c" between the right hanging step 66 and the left hanging step 63, for removing the locking member 6, the locking member 6 is required to be removed to the position shown in FIG. 8, i.e. a third position where the right hanging step 66 and the right fastening 13 are not engaged with each other while the left hanging step 63 and the left fastening 16 are not engaged with each other. Then the auxiliary hanging part 64 and the auxiliary hanging groove 14 are disengaged with each other through pulling the left side of the locking member upwards or levering the left side of the locking member using a tool, so as to remove the locking member 6 from the lid 1.

Figure 9:
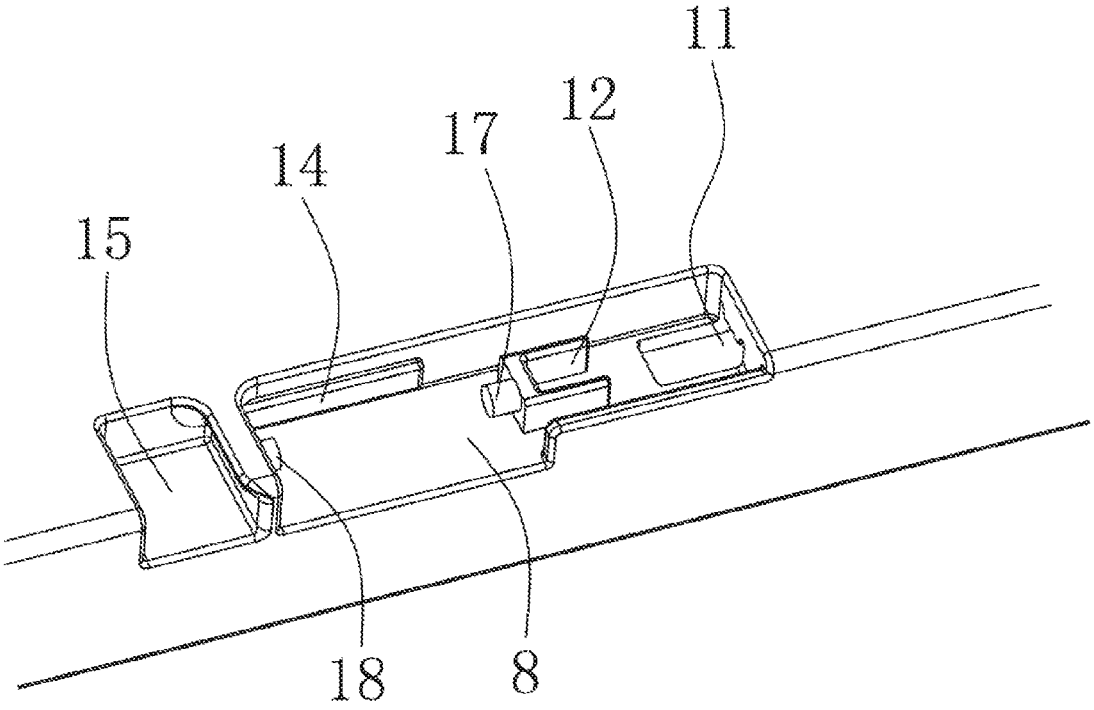
FIG. 9 is a schematic perspective view of the lid edge structure of a lid locking mechanism of a container according to the second embodiment of the present invention.
Figure 10:
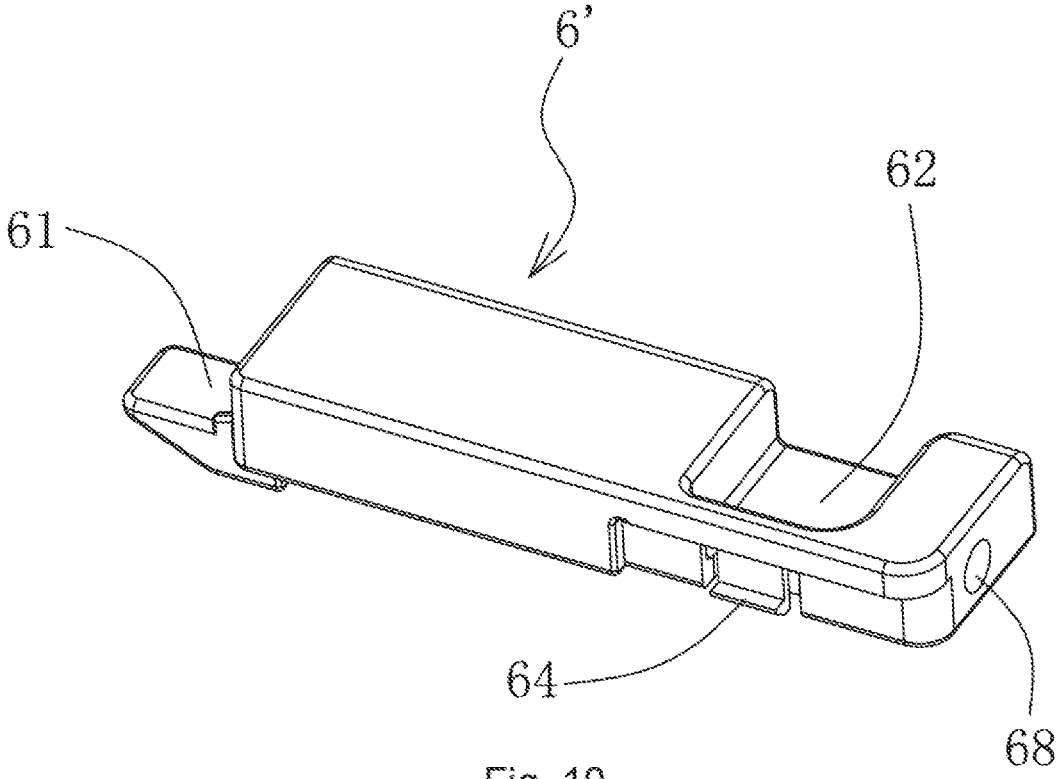
FIG. 10 is a perspective structure view of the locking member of the lid locking mechanism of a container according to the second embodiment of the present invention in a visual angle.
Figure 11:
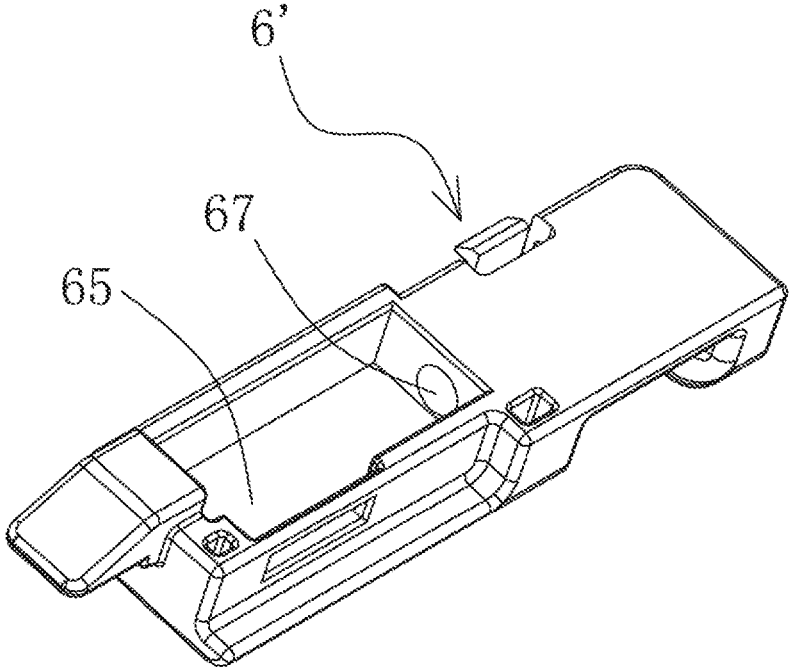
FIG. 11 is a perspective structure view of the locking member of the lid locking mechanism of a container according to the second embodiment of the present invention in another visual angle.

FIG. 9 is a schematic perspective view of the lid edge structure of a lid locking mechanism of a container according to a second embodiment of the present invention; and FIGS. 10 and 11 are perspective structure view of the locking member of the lid locking mechanism of a container according to a second embodiment of the present invention in different visual angles. The difference between the present embodiment and the first embodiment is as follows: in the present embodiment, a left pin 18 and a right pin 17 are provided in the pit 8 of the edge of the lid 1 for replacing the left fastening 16 and the right fastening 13 respectively, and a left pin hole 68 and a right pin hole 67 are provided in the locking member 6' for replacing the left hanging step 63 and the right hanging step 66 respectively. The right pin 17 is inserted into the right pin hole 67 when the locking mechanism is in the locking state and the left pin 18 is inserted into the left pin 68 when the locking mechanism is in the unlocking state. A distance between the left pin hole 68 and the right pin hole 67 is shorter than a distance between end surface of the left pin 18 and end surface of the right pin 17, so that the locking member is easy to be installed on the lid or removed from the lid. The working principle of the present embodiment is substantially as the same as that of the first embodiment, and there is only different in structure for implementing the corresponding functions. It should be understood that, in a modified embodiment, the left pin and right pin also can be provided on the locking member, and the left pin hole and the right pin hole are provided in the pit of the lid edge correspondingly.

In the present invention, the locking mechanism is reasonably provided with two pairs of the hanging steps and fastenings (or pins and pin holes, etc.) as well as a pair of auxiliary hanging step and auxiliary hanging groove, so as to more conveniently install or remove the locking mechanism and ensure the smoothness of operation of the locking mechanism. In the present invention, an auxiliary pit is also designed on the lid edge, so that the removing operation of lid is more convenient and of less effort and the weight shared by the lock member when lifting the lid is reduced, thus increasing reliability of the locking member and prolonging service life of the locking member.

Preferred embodiments of the present invention has been described in detail above, while it is to be understood that, after reading the above teachings of the present invention, those skilled in the art may make various modifications or amendments to the present invention. These equivalent forms still fall into the scope limited by appended claims of the present application.

What is claimed is:

1. A lid locking mechanism of a container having a base, side plates and a lid, the lid locking mechanism comprising:

a locking member, a reset member, a pit and an opening located on an edge of the lid, and a locking hole located on the side plates, wherein the locking member consists of a locking body and a latch extending from the locking body, and the reset member may keep the locking member in a locking position, and the pit is used for accommodating the locking body, and two pairs of position limiting structures are provided on the locking member and in the pit located on the edge of the lid; and one pair of the position limiting structures provided on the locking member and on the lid are cooperated with each other so as to limit the position of the locking member, and the latch passes through the opening located on the edge of the lid and is snapped into the locking hole located on the side plates when the lid is locked on the side plates by the locking mechanism;

an other pair of the position limiting structures provided on the locking member and on the lid are cooperated with each other so as to limit the position of the locking member, and the latch exits from the locking hole located on the side plates when the locking mechanism is in an unlocking state.

2. The lid locking mechanism of a container of claim 1, wherein the two pairs of the position limiting structures are provided so that there is a third position where the two pairs of the position limiting structures are both disengaged with each other during a process that the locking member moves in the pit located on the edge of the lid, and it is convenient to install the locking member on the lid or remove the locking member from the lid due to a presence of the third position.

3. The lid locking mechanism of a container of claim 2, wherein a pair of auxiliary position limiting structures are provided on the locking member and on the edge of the lid, and the auxiliary position limiting structures are always cooperated with each other during the process that the locking member moves in the pit located on the edge of the lid, so as to prevent the locking member from easily removing from the lid due to misoperation when the locking member moves to the third position.

4. The lid locking mechanism of a container of claim 1, wherein the reset member is a spring, and the pit located on the edge of the lid is provided with an opening groove, and the locking member is provided with a bottom pit, and the spring is installed in a space formed by the opening groove and the bottom pit, and a length of a portion of the bottom pit accommodating the spring is shorter than a nature length of the spring.

5. The lid locking mechanism of a container of claim 1, wherein the two pairs of the position limiting structures consists of two fastenings provided on the locking members and two corresponding hanging steps provided in the pit located on the edge of the lid, wherein one fastening and one corresponding hanging step form a pair of position limiting structures.

6. The lid locking mechanism of a container of claim 1, wherein the two pairs of the position limiting structures consist of two pin holes provided on the locking members and two corresponding position limiting pins provided in the pit located on the edge of the lid, wherein one pin hole and one corresponding position limiting pin form a pair of position limiting structures.

7. The lid locking mechanism of a container of claim 1, wherein the locking member is provided with a locking member pit and the edge of the lid is provided with an auxiliary pit, wherein the auxiliary pit and the locking member pit are used to accommodate fingers and used as a site for applying force from fingers.

8. The lid locking mechanism of a container of claim 3, wherein the pair of the auxiliary position limiting structures consists of an auxiliary hanging part provided on the locking member and an auxiliary hanging groove provided in the pit located on the edge of the lid, wherein the auxiliary hanging part keeps engaging with the hanging groove and the auxiliary part slides along the auxiliary groove during a process that the locking member moves in the pit located on the edge of the lid.

9. The lid locking mechanism of a container of claim 1, wherein the latch has a slop.

10. A container including a base, a side plate and a lid, wherein the container further includes the lid locking mechanism of a container according to claim 1.

* * * * *